United States Patent [19]

Agrawal et al.

[11] Patent Number: 5,006,139

[45] Date of Patent: Apr. 9, 1991

[54] CRYOGENIC AIR SEPARATION PROCESS FOR THE PRODUCTION OF NITROGEN

[75] Inventors: Rakesh Agrawal, Allentown; Donald W. Woodward, New Tripoli, both of Pa.

[73] Assignee: Air Products and Chemicals, Inc., Allentown, Pa.

[21] Appl. No.: 491,420

[22] Filed: Mar. 9, 1990

[51] Int. Cl.[5] ..... F25J 3/02

[52] U.S. Cl. ..... 62/24; 62/38; 62/42

[58] Field of Search ..... 62/11, 13, 24, 31, 32, 62/36, 38, 42, 44

[56] References Cited

U.S. PATENT DOCUMENTS 4,400,188 8/1983 Patel et al. ..... 62/31

4,705,548 11/1987 Agrawal et al. ..... 62/22

4,916,908 8/1990 Lavin et al. ..... 62/24

*Primary Examiner*—Ronald C. Capossela

*Attorney, Agent, or Firm*—Willard Jones, II; William F. Marsh; James C. Simmons

[57] ABSTRACT

The present invention is a cryogenic process for the production of nitrogen by distilling air in a double column distillation system comprising a high pressure column and a low pressure column. The critical step of the invention is the condensation of two nitrogen streams at different pressures in two reboiler/condensers located in the stripping section of the low pressure column to provide column reboil. The lower pressure of the two nitrogen streams is condensed in the upper of the two reboiler/condensers; the higher pressure nitrogen stream in the lower of the two reboiler/condensers.

13 Claims, 8 Drawing Sheets

COMPRESSED AIR
10
HPGAN
124
126
128
356
358
LPGAN
53
WASTE
360
12
14
16
18
20
22
24
26
36
40
42
44
46
48
50
52
56
58
PURGE
100
102
104
106
108
128
130
132

COMPRESSED AIR
HP GAN
LP GAN
WASTE
PURGE
10
12
14
16
18
20
22
24
26
36
40
42
44
46
48
50
52
53
54
56
57
58
60
62
64
100
102
104
106
108
126
128
130
132
518
520
522
524
526
528

CRYOGENIC AIR SEPARATION PROCESS FOR THE PRODUCTION OF NITROGEN

TECHNICAL FIELD

The present invention is related to a process for the cryogenic distillation of air to produce large quantities of nitrogen.

BACKGROUND OF THE INVENTION

Numerous processes are known in the art for the production of large quantities of high pressure nitrogen by using cryogenic distillation; among these are the following:

The conventional double column process originally proposed by Carl Von Linde and described in detail by several others, in particular, M. Ruhemann in "The Separation of Gases" published by Oxford University Press, Second Edition, 1952, R.E. Latimer in "Distillation of Air" published in Chem. Eng. Prog., 63 (2), 35 (1967); and H. Springmann in "Cryogenics Principles and Applications" published in Chem. Eng., pp 59, May 13, 1985; is not useful when pressurized nitrogen is the only desired product. This conventional double column process was developed to produce both pure oxygen and pure nitrogen products. To achieve this end, a high pressure (HP) and a low pressure (LP) column, which are thermally linked through a reboiler/condenser, are used. To effectuate and produce a pure oxygen product stream, the LP column is run at close to ambient pressure. This low pressure of the LP column is necessary to achieve the required oxygen/argon separation with reasonable number of stages of separation.

In the conventional double column process, nitrogen is produced from the top of the LP and HP columns and oxygen from the bottom of the LP column. However, when pure nitrogen is the only desired product and there is no requirement to produce pure oxygen or argon as co-products, this conventional double column process is inefficient. A major source of the inefficiency is due to the fact that the nitrogen/oxygen distillation is relatively easy in comparison to the oxygen/argon distillation and the lower pressure of the LP column (close to ambient pressure) contributes significantly to irreversibility of the distillation process and requires lower pressures for the other process streams, which for a given size of equipment leads to higher pressure drop losses in the plant.

Attempts have been made in the past to improve the performance of this conventional double column process by increasing the pressure of the LP column to 30–60 psia, one such attempt is disclosed by R.M. Thorogood in "Large Gas Separation and Liquefaction Plants" published in Cryogenic Engineering, editor B. A. Hands, Academic Press, London (1986). As a result of increasing the LP column pressure, the HP column pressure is increased to about 100–150 psia. Nitrogen recovery is 0.65–0.72 moles per mole of feed air. Instead of pure oxygen, an oxygen-enriched (60–75% oxygen concentration) waste stream is withdrawn from the bottom of the LP column. Since this stream is at a pressure higher than the ambient pressure, it can be expanded to produce work and provide a portion of the needed refrigeration for the plant. Also, the LP column does not need large amounts of reboiling to produce a 60–75% oxygen stream. As a result, the efficiency of the plant is improved by producing a fraction of the nitrogen product at high pressure from the top of the HP column (about 10–20% of feed air as high pressure nitrogen), however, some major inefficiencies still remain. Since the flowrate of the oxygen-enriched waste stream is essentially fixed (0.25–0.35 moles/mole of feed air), the pressure of the oxygen-enriched waste stream is dictated by the refrigeration requirements of the plant; thus dictating the corresponding pressure of the LP column. Any attempt to further increase the pressure of the LP column to reduce the distillation irreversibilities leads to excess refrigeration across the turboexpander; thus causing overall higher specific power requirements. Another inefficiency in this process is the fact that a large quantity of the oxygen-enriched liquid needs to be reboiled in the LP column reboiler/condenser. These large quantities mean a large temperature variation on the boiling side of the reboiler/condenser compared to the fairly constant temperature on the condensing side for the pure nitrogen; thus contributing to higher irreversible losses across the reboiler/condenser.

U.S. Pat. No. 4,617,036 discloses a process which addresses some of the above described inefficiencies by using two reboiler/condensers. In this arrangement, rather than withdrawing an oxygen-enrich waste stream as vapor from the bottom of LP column, the oxygen-enriched waste stream is withdrawn as a liquid. This liquid stream is then reduced in pressure across a Joule-Thompson (JT) valve and vaporized in a separate external boiler/condenser against a condensing portion of the high pressure nitrogen stream from the top of the HP column. The vaporized oxygen-rich stream is then expanded across a turboexpander to produce work and provide a portion of the needed refrigeration. Reboil of the LP column is provided in two stages, thereby, decreasing the irreversibility across the reboiler/condenser, as is reflected in the fact that for the same feed air pressure, the LP column operates at a higher pressure, about 10–15 psi. As a result, the portion of nitrogen product collected from the top of the LP column is also increased in pressure by the same amount. This leads to a savings in energy for the product nitrogen compressor.

A similar process is disclosed in United Kingdom Patent No. GB 1,215,377; a flowsheet derived from this process is shown in FIG. 1. Like U.S. Pat. No. 4,617.036, this process collects an oxygen-rich waste stream as liquid from the bottom of the LP column and vaporizes it in an external reboiler/condenser. The condensing fluid, however, is low pressure nitrogen (40–65 psia) from the top of the LP column. The condensed nitrogen is returned as reflux to the top of the LP column thus decreasing the need for pure nitrogen reflux derived from the HP column. In turn, more gaseous nitrogen can be recovered as product from the top of the HP column (30–40% of the feed air stream) making the process more energy efficient. Furthermore, the condensation of LP column nitrogen against the oxygen-enriched waste stream allows for an increase in the pressure of both the distillation columns. Which, in turn, makes these columns operate more efficiently and results in higher pressure nitrogen product streams. The increased pressure of these product streams along with the increased pressure of the feed air stream together result in lower pressure drop losses which further contributes to process efficiency.

Another similar process is disclosed in U.S. Pat. No. 4,453,957.

A detailed study of the above two processes is given by Pahade and Ziemer in their paper "Nitrogen Production For EOR" presented at the 1987 International Cryogenic Materials and Cryogenic Engineering Conference.

U.S. Pat. No. 4,439,220 discloses a variation on the process of GB 1,215,377 wherein rather than reboiling the LP column with high pressure nitrogen from the top of the HP column, the pressure of the crude liquid oxygen from the bottom of the HP column is decreased and vaporized against the high pressure nitrogen. The vaporized stream forms a vapor feed to the bottom of the LP column. The liquid withdrawn frOm the bottom of the LP column is the oxygen-enriched waste stream, similar to the process shown in FIG. 1, which is then vaporized against the condensing LP column nitrogen. A drawback of this process is that the liquid waste stream leaving the bottom of the LP column is essentially in equilibrium with the vaporized liquid leaving the bottom of the HP column. The liquid leaving the bottom of the HP column is essentially in equilibrium with the feed air stream and therefore oxygen concentrations are typically about 35%. This limits the concentration of oxygen in the waste stream to below 60% and leads to lower recoveries of nitrogen in comparison to the process of GB 1,215,377.

A more efficient process is disclosed in U.S. Pat. No. 4,543,115. In this process, feed air is fed as two streams at different pressures. The higher pressure air stream is fed to the HP column and the lower pressure air is fed to the LP column. The reboiler/condenser arrangement is similar to GB 1,215,377, however, no high pressure nitrogen is withdrawn as product from the top of the HP column and therefore the nitrogen product is produced at a single pressure close to the pressure of the LP column. This process is specially attractive when all the nitrogen product is needed at a pressure lower than the HP column pressure (40–70 psia).

The processes described so far have a large irreversible losses in the bottom section of the LP column, which is primarily due to reboiling large quantities of impure liquid across the bottom LP column reboiler/condenser, leading to substantial temperature variations across the reboiler/condenser on the boiling side; the temperature on the nitrogen condensing side is constant. This, in turn, leads to large temperature differences between condensing and boiling sides in certain sections of reboiler/condenser heat exchanger and contributes to the inefficiency of the system. Additionally, the amount of vapor generated at the bottom of the LP column is more than is needed for the efficient stripping in this section to produce oxygen-enriched liquid (70% $O_2$) from this column. This leads to large changes in concentration across each theoretical stage in the stripping section and contributes to the overall inefficiency of the system.

When an impure oxygen stream is withdrawn from the bottom of a LP column of a double column distillation system, the use of two or more reboilers in the bottom section of the LP column to improve the distillation efficiency has been disclosed by J.R. Flower, et al. in "Medium Purity Oxygen Production and Reduced Energy Consumption in Low Temperature Distillation of Air" published in AICHE Symposium Series Number 224, Volume 79, pp4 (1983) and in U.S. Pat. No. 4,372,765. Both use intermediate reboiler/condensers in the LP column and partially vaporize liquid at intermediate heights of the LP column. The vapor condensed in the top-most intermediate reboiler/condenser is the nitrogen from the top of the HP column. The lower intermediate reboiler/condensers condense a stream from the lower heights of the HP column with the bottom most reboiler/condenser getting the condensing stream from the lowest position of the HP column. In certain instances, the bottom most reboiler/condenser heat duty for reboiling is provided by condensing a part of the feed air stream as is disclosed in U.S. Pat. No. 4,410,343. When nitrogen from the top of the HP column is condensed in an intermediate reboiler/condenser, it can be condensed at a lower temperature and therefore its pressure is lower as compared to its condensation in the bottom most reboiler/condenser. This decreases the pressure of the HP column and hence of the feed air stream and leads to power savings in the main air compressor.

Attempts to extend the above concept of savings for impure oxygen production with multiple reboiler/condensers in the bottom section of the LP column to the nitrogen production cycles have been disclosed in U.S. Pat. Nos. 4,448,595 and 4,582,518. In U.S. Pat. No. 4,448,595, the pressure of the oxygen-rich liquid is reduced from the bottom of the HP column to the LP column pressure and boiled against the high pressure nitrogen from the top of the HP column in a reboiler/condenser. The reboiled vapor is fed to an intermediate location in the LP column. This step operates in principle like obtaining a liquid stream from the LP column of a composition similar to the oxygen-rich liquid from the bottom of the HP column, boiling it and feeding it back to the LP column. However, the situation in U.S. Pat. No. 4,448,595 is worse than feeding oxygen-rich liquid from the bottom of the HP column to the LP column and then through an intermediate reboiler/condenser partially vaporize a portion of the liquid stream to create the same amount of vapor stream in the LP column, thus decreasing the irreversible losses across this reboiler/condenser. Furthermore, feeding oxygen-rich liquid from the HP column to the LP column provides another degree of freedom to locate the intermediate reboiler/condenser at an optimal location in the LP column rather than boiling a fluid whose composition is fixed within a narrow range (35% $O_2$). U.S. Pat. No. 4,582,518 does exactly the same. In the process, the oxygen-rich liquid is fed from the bottom of the HP column to the LP column and is boiled at an intermediate location of the LP column with an internal reboiler/condenser located at the optimal stage.

On the other hand, U.S. Pat. No. 4,582,518 suffers from another inefficiency. A major fraction of the feed air is fed to the reboiler/condenser located at the bottom of the LP column, however, only a fraction of this air to the reboiler/condenser is condensed. The two phase stream from this reboiler/condenser is fed to a separator. The liquid from this separator is mixed with crude liquid oxygen from the bottom of the HP column and is fed to the LP column. The vapor from this separator forms the feed to the HP column. The process uses only pure nitrogen liquid to reflux both columns: no impure reflux is used. As a result, a large fraction of the nitrogen product is produced at low pressure from feed air and any benefits gained from the decreased main air compressor pressure is eliminated in the product nitrogen compressors.

Both U.S. Pat. Nos. 4,448,595 and 4,582,518 in following the principles developed for impure oxygen production have succeeded in reducing the pressure of the HP column and therefore the lowering the discharge pressure of the air from the main air compressor. However, they introduce other inefficiencies which substantially increase the proportion of low pressure nitrogen from the cold box. This saves power on the main air compressor but does not provide the lowest energy high pressure nitrogen needed for enhanced oil recovery (pressure generally greater than 500 psia). In short, neither of these two U.S. Patents is successful in fully exploiting the potential of multiple reboiler/condensers in the stripping section of the LP column.

In addition to the double column nitrogen generators described above, considerable work has been done on single column nitrogen generators, which are disclosed in U.S. Pat. Nos. 4,400,188; 4,464,188, 4,662,916; 4,662,917 and 4,662,918. These processes of these patents use one or more recirculating heat pump fluids to provide the boilup at the bottom of the single columns and supplement the nitrogen reflux needs. Use of multiple reboiler/condensers and prudent use of heat pump fluids make these processes quite efficient. However, the inefficiencies associated with the large quantities of recirculating heat pump fluids contribute to the overall inefficiency of the system and these processes are no more efficient than the most efficient double column processes described above from the literature.

Due to the fact that energy requirement of these large nitrogen plants is a major component of the cost of the nitrogen, it is highly desirable to have plants which can economically further improve the efficiency of the nitrogen production.

SUMMARY OF THE INVENTION

The present invention is a cryogenic process for the production of nitrogen by distilling air in a double column distillation system comprising a high pressure column and a low pressure column. In the process a compressed feed air stream is cooled to near its dew point and rectified in the high pressure distillation column thereby producing a high pressure nitrogen overhead and a crude oxygen bottoms liquid. The crude oxygen bottoms liquid is removed from the high pressure distillation column, subcooled and fed to an intermediate location of the low pressure column for distillation. The high pressure nitrogen overhead is removed from the high pressure column and divided into a first and second portion. The first portion of the high pressure nitrogen overhead is condensed in an intermediate reboiler/condenser located in the upper portion of the stripping section of the low pressure column thereby providing at least a portion of the heat duty to reboil the low pressure column. The second portion of the high pressure nitrogen overhead is warmed and divided into a high pressure nitrogen product and a recycle nitrogen stream. The recycle nitrogen stream is compressed and then condensed in a reboiler/condenser located in the bottom of the low pressure column thereby providing another portion of the heat duty to reboil the low pressure column. The high pressure column is refluxed with at least a portion of the condensed nitrogen. A low pressure nitrogen stream is removed from the top of the low pressure column, warmed to recover refrigeration and recovered as low pressure nitrogen product.

The process of present invention further comprises removing a portion of the cooled compressed feed air, and expanding the removed portion to generate work. This expanded portion can be cooled and fed to an intermediate location of the low pressure column for distillation or warmed and vented from the process.

Another embodiment of the process of the present invention further comprises removing an oxygen-enriched bottoms liquid from the bottom of the low pressure column; vaporizing the removed, oxygen-enriched bottoms liquid in a reboiler/condenser located in the top of the low pressure column against condensing low pressure nitrogen overhead thereby creating a oxygen-waste stream; warming the oxygen-waste stream to recover refrigeration; expanding the warmed, oxygen-waste stream to produce work; and further warming the expanded oxygen-waste stream to recover any remaining refrigeration.

Additional reboil for the low pressure column can be provided by condensing a portion of the cooled compressed feed air stream in a reboiler/condenser located in the low pressure column between the intermediate reboiler/condenser and the bottom reboiler/condenser.

Finally, two additional embodiments are possible for the provision of the recycle nitrogen stream. In one, the second portion of the high pressure nitrogen overhead is recovered as a high pressure nitrogen product and a recycle nitrogen stream and the warmed low pressure nitrogen stream is separated into a low pressure nitrogen product and a nitrogen recycle stream. In the other, the entire second portion of the high pressure nitrogen overhead is used as the recycle nitrogen stream.

DETAILED DESCRIPTION OF THE INVENTION

The present invention relates to an improvement to a cryogenic air separation process for the production of large quantities of nitrogen using double column distillation system having HP and LP columns. The improvement for the production of nitrogen in a more energy efficient manner is effectuated by the use of multiple (preferably two) reboiler/condensers in the stripping section of the LP column. These multiple reboiler/condensers are located at different heights with one or more distillation trays between each of them. The present invention requires that two nitrogen streams, each at different pressures, be condensed in these reboiler/condensers. The first nitrogen stream, the higher pressure stream of the two streams, is condensed in the reboiler/condenser located at the bottom of the LP column, and the second nitrogen stream, the lower pressure stream of the two streams is condensed in the reboiler/condenser located one or more trays or theoretical stages above the reboiler/condenser where higher pressure nitrogen stream is condensed.

These condensed nitrogen streams provide at least a portion of the reflux needed for the HP column. Although the streams can be derived from any appropriate location of the process, preferably, the lower pressure nitrogen vapor stream to be condensed is obtained from the top of the HP column. The higher pressure nitrogen stream is obtained by boosting the pressure of a suitable nitrogen stream from the distillation column(s). The nitrogen stream most suited for this purpose is obtained from the top of the HP column. The preferred double distillation column system for this invention also uses a reboiler/condenser located at the top of the LP column. In this top reboiler/condenser, an oxygen enriched liquid stream withdrawn from the bottom of the LP column is boiled against the condensation of a nitrogen stream from the top of the LP column. This condensed nitrogen stream is returned as reflux to the LP column. This invention will now be described in detail with reference to several embodiments as depicted in FIGS. 2 through 8.

Figure 2:
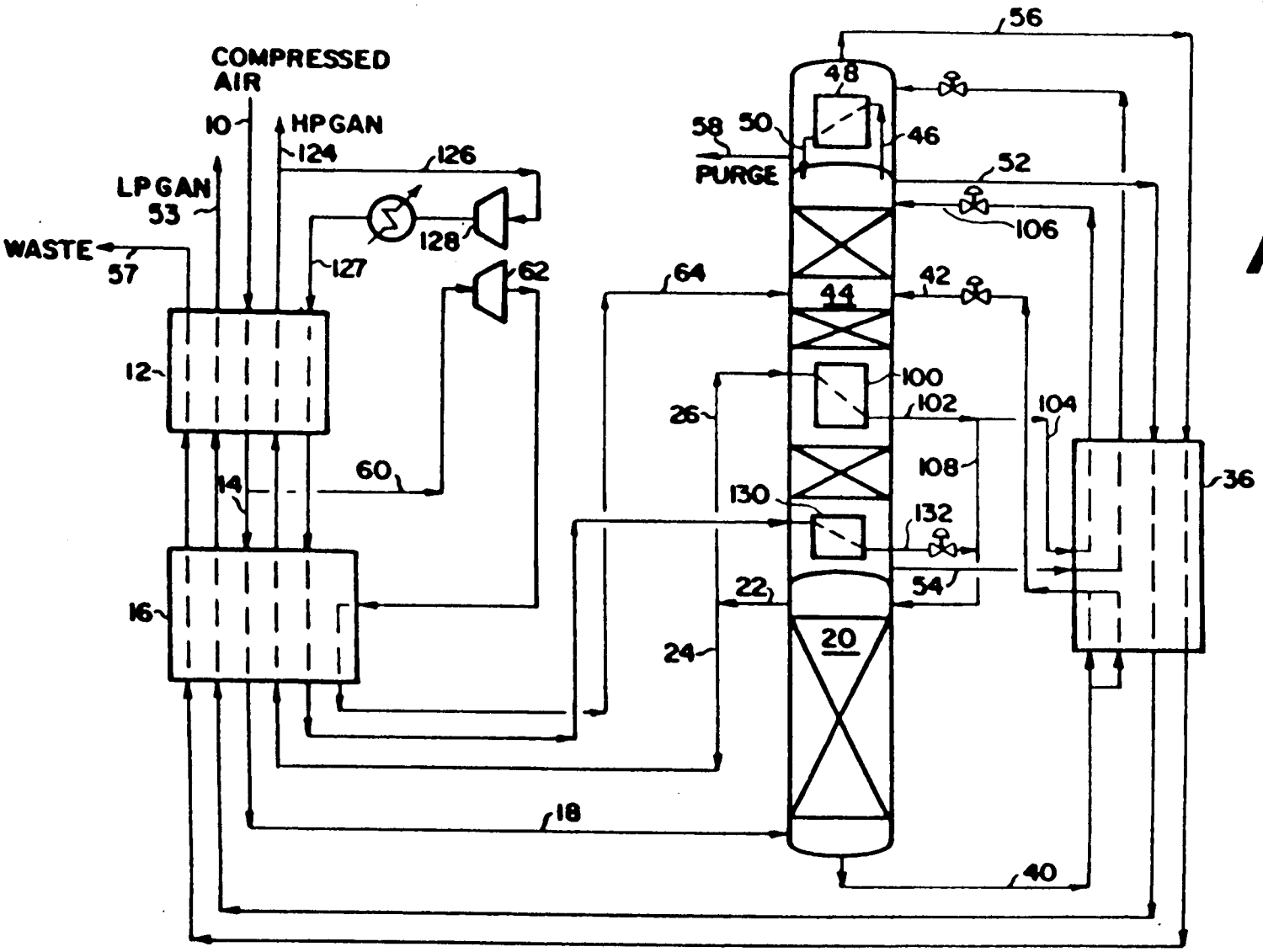
FIGS. 2-8 are flow diagrams of specific embodiments of the process of the present invention.

The invention, in its simplest embodiment, is depicted in FIG. 2. A feed air stream, which has been compressed in a multistage compressor to a pressure of about 70-350 psia, cooled with a cooling water and a chiller and then passed through a molecular sieve bed to remove water and carbon dioxide contaminants, is fed to the process via line 10. This compressed, carbon dioxide and water-free feed air stream is then cooled in heat exchangers 12 and 16 and fed to HP distillation column 20 via line 18. In addition, a portion of feed air is removed, via line 60, and expanded across turboexpander 62 to provide the refrigeration for the process. This expanded stream is then fed to a suitable location of LP distillation column 44, va line 64. The flow rate of the side stream in line 60 ranges between 5-20% of the flowrate of feed air, in line 10, depending on process refrigeration needs. Process refrigeration needs depend on the size of the plant and the required quantities of liquid products, if any.

The cooled, compressed feed air, in line 18, is rectified in HP column 20 to produce a pure nitrogen overhead at the top of HP column 20 and an oxygen-enriched crude bottoms liquid at the bottom of HP column 20. The oxygen-enriched crude bottoms liquid is removed from HP column 20, via line 40, subcooled in heat exchanger 36, reduced in pressure and fed to LP column 44, via line 42. The nitrogen overhead is removed from HP column 20, via line 22, and split into two portions. The flow rate of portion in line 24 is about 25-85% of the flow rate of nitrogen overhead in line 22.

The first portion of the HP column overhead, in line 26, is condensed in reboiler/condenser 100 located in an intermediate location of the stripping section of LP column 44 and split into two liquid portions. The first liquid portion, in line 104, is subcooled in heat exchanger 36, reduced in pressure and fed to LP column 44, via line 106, as reflux. The second liquid portion, in line 108, is fed to the top of HP column 20 as reflux.

The second portion of the HP column overhead, in line 24, is warmed in heat exchangers 16 and 12 to recover refrigeration, and split into two further portions. The first further portion is removed from the process as high pressure gaseous nitrogen product (HPGAN), via line 124. The second further portion, in line 126, is compressed, cooled in heat exchangers 12 and 16, condensed in reboiler/condenser 130 located in the bottom of LP column 44, reduced in pressure, combined with the second liquid portion, in line 108, and fed to the top of HP column 20 as reflux.

The feed streams, lines 42 and 64, to LP column 44 are distilled to provide a nitrogen-rich overhead at the top of LP column 44 and a oxygen-rich bottoms liquid at the bottom of LP column 44. A portion of the oxygen-rich bottoms liquid is vaporized in reboiler/condenser 130 to provide reboil for LP column 44 and another portion is removed, via line 54, subcooled in heat exchanger 36, let down in pressure and fed to the sump surrounding reboiler/condenser 48 located at the top of LP column 44.

A portion of the LP column nitrogen overhead is removed from LP column 44, via line 46, condensed in reboiler/condenser 48 and returned as reflux via line 50. The condensing of this portion of the LP column nitrogen overhead, the oxygen-rich liquid surrounding reboiler/condenser 48 is vaporized and the produced vapor is removed, via line 56, warmed in heat exchangers 36, 16 and 12 to recover refrigeration, and typically vented to the atmosphere as waste for plants built for nitrogen product only. On the other hand, there are instances where this stream can be a useful product stream. In a plant using a mole sieve unit to remove carbon dioxide and water from the feed air, a portion of this waste stream would be used to regenerate the mole sieve beds. The typical concentration of oxygen in the waste stream is more than 50% and optimally in the range of 70-90%. Its flow rate will be in the range of 23-40% of the feed air flow to the plant; preferably around 26-30% of the feed air flow.

The remaining portion of the LP column nitrogen overhead is removed from the top of LP column 44, via line 52. It is then warmed in heat exchangers 36, 16 and 12 to recover refrigeration and removed from the process as low pressure nitrogen product (LPGAN). This LPGAN constitutes a portion of the nitrogen product stream. Its pressure can be typically in the range of 35-140 psia, with preferable range of 50-80 psia. Basically, this is also the pressure range of the LP column operation. The flowrate of LPGAN is 20-65% of the feed air flowrate.

The important step of the process of the present invention is the compression of the second further portion, in line 126, and its condensation in bottom reboiler/condenser 130, thereby providing the needed boilup to the bottom of the LP column. This condensed nitrogen stream, in line 132, is then reduced in pressure and fed at the top of the HP column as reflux. Although there only needs to be one tray between reboiler/condenser 130 and reboiler/condenser 100, the preferred number of trays or equilibrium stages would be in the range of about 3 to about 10 stages. The pressure of the compressed second further portion, in line 127, is typically 5-60 psi higher than the first portion of the nitrogen overhead, in line 26. The optimal range for the pressure of the compressed second further portion is about 15-40 psi higher than the top of the HP column pressure. The flowrate of stream 126 will be typically in the range of 5-40% of the feed air flowrate; the optimal flowrate is 10-30%.

Even though FIG. 2 shows compressor 128 and expander 62 as separate items indicating that they are independently driven. It is possible to link both in a compander fashion. This eliminates the need to buy a new compressor and saves the associated capital cost. However, this presents a constraint in that the amount of energy available from the turboexpander is limited by the refrigeration needs and that limits the amount of nitrogen which can be boosted in the compressor of the compander. If the amount of recycle nitrogen, in line 126, needed for the efficient operation of the plant is in excess of the maximum amount of compressed nitrogen available from a compander then the requirement for an electric motor driven booster compressor becomes important. Nevertheless, as will be shown later through examples, for a typical plant this is not the case and the use of a compander system is very attractive.

In FIG. 2, the second further portion, in line 126, is compressed in warm booster compressor 128. As an alternative, a portion of the nitrogen overhead first portion, in line 24, could be cold compressed in a cold booster compressor with the inlet temperature close to the HP column temperatures. In this case, a larger quantity of air will have to be expanded in the turboexpander 62 to generate the required refrigeration.

The embodiment illustrated in FIG. 2 demonstrates the main concept of the process of the present invention, however, many other embodiments are possible. Alternate embodiments as depicted in FIGS. 3-8 will be discussed to demonstrate a much wider applicability of the general concept.

Figure 3:
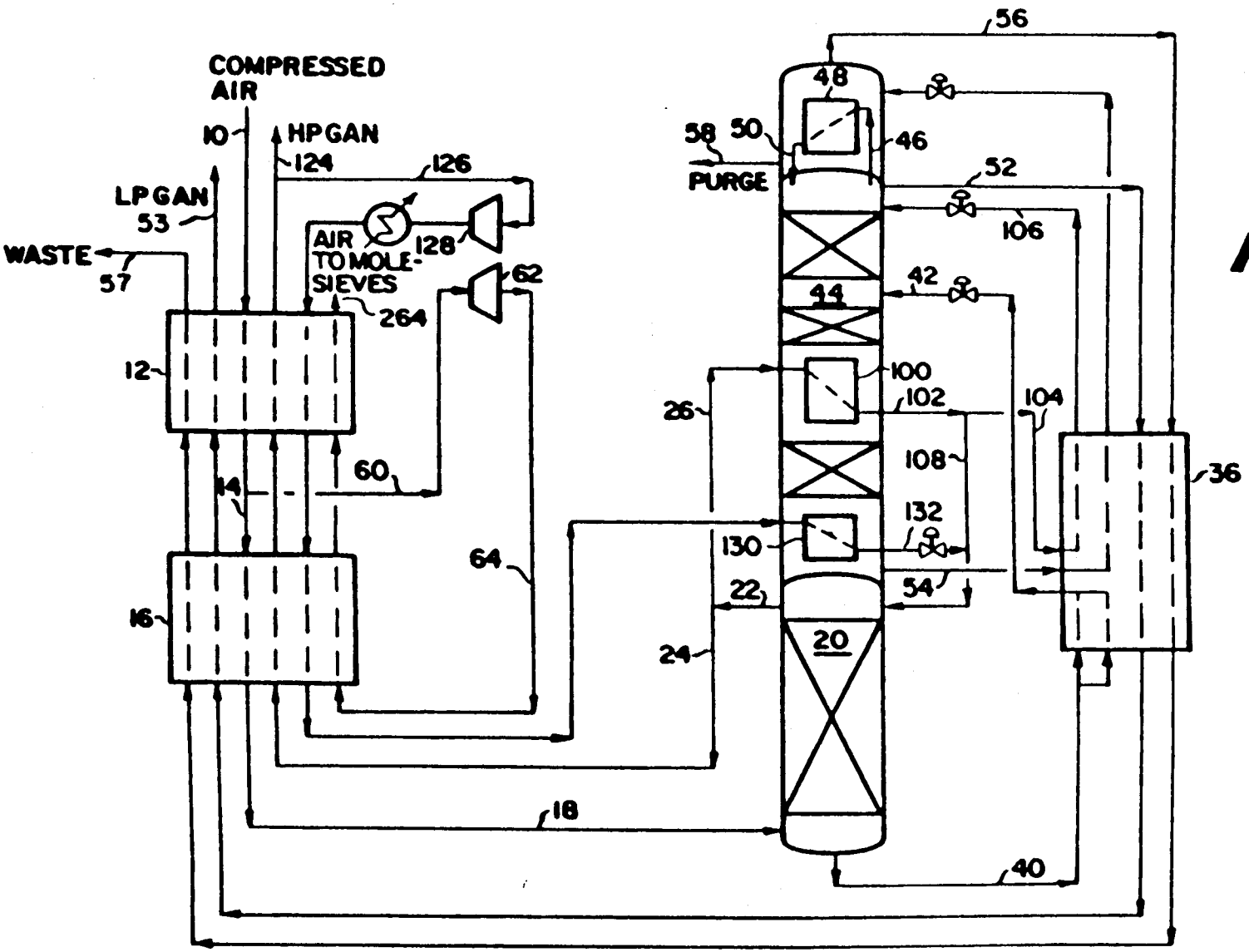

In FIG. 2, refrigeration for the process is provided by expanding a portion of the feed air stream, line 60, in turboexpander 62 and then feeding the expanded feed air into LP column 44. Alternatively, as shown in FIG. 3, this portion, line 60, could be expanded to a much lower pressure and then warmed in the heat exchangers 16 and 12 to provide a low pressure air stream, in line 264. This low pressure air stream, in line 264, can then be used to regenerate the mole sieve bed used to remove water and carbon dioxide from the feed air.

Figure 4:
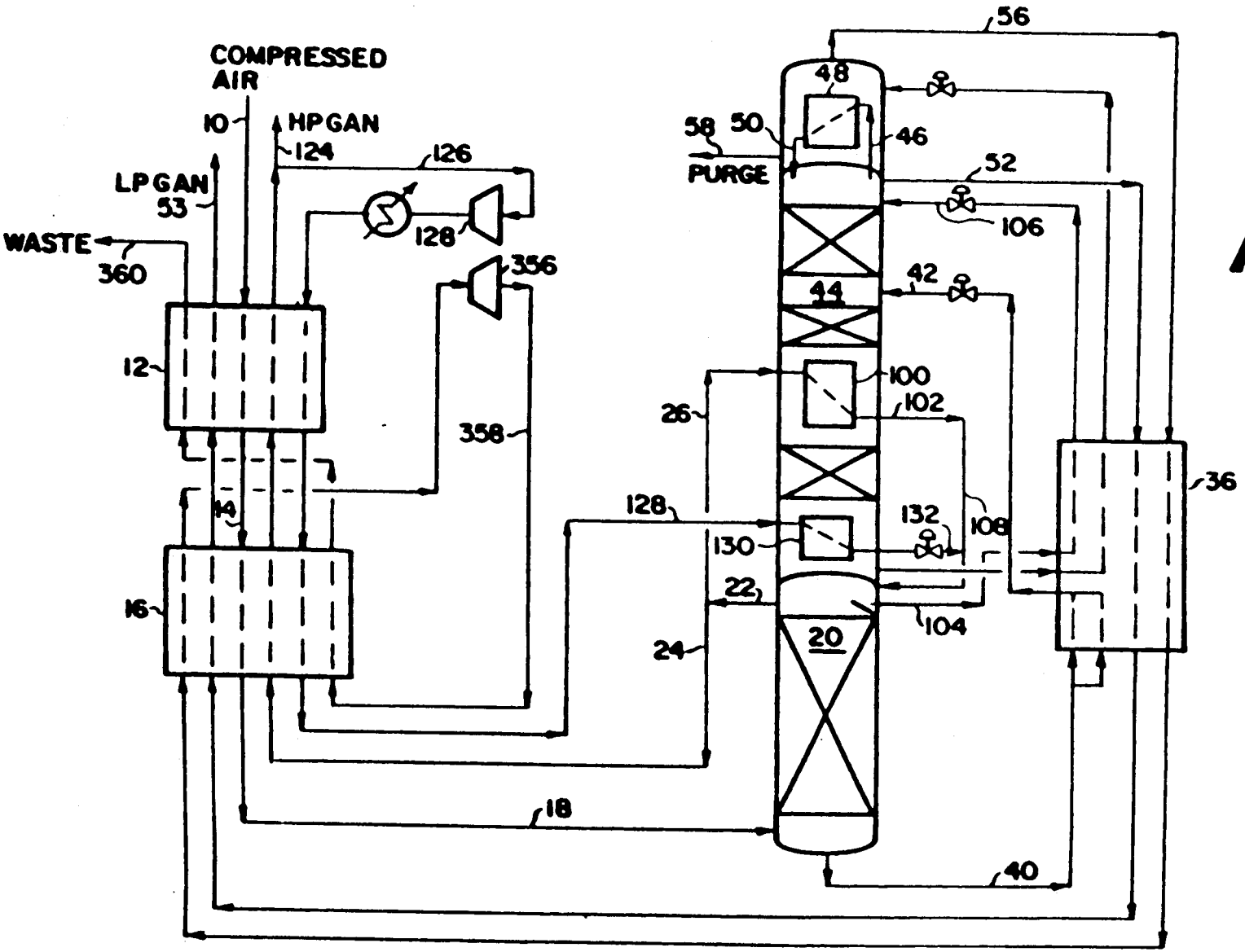

It is also possible to expand a stream other than a portion of the feed air for the refrigeration. For example, FIG. 4 shows a scheme wherein the oxygen-rich vapor, in line 56, from the reboiler/condenser 48 can be expanded in turboexpander 356 to provide the needed refrigeration. Alternatively, although not shown, a portion of the HP column overhead, in line 22, could be expanded to the LP column nitrogen pressure to meet the refrigeration requirement.

Figure 5:
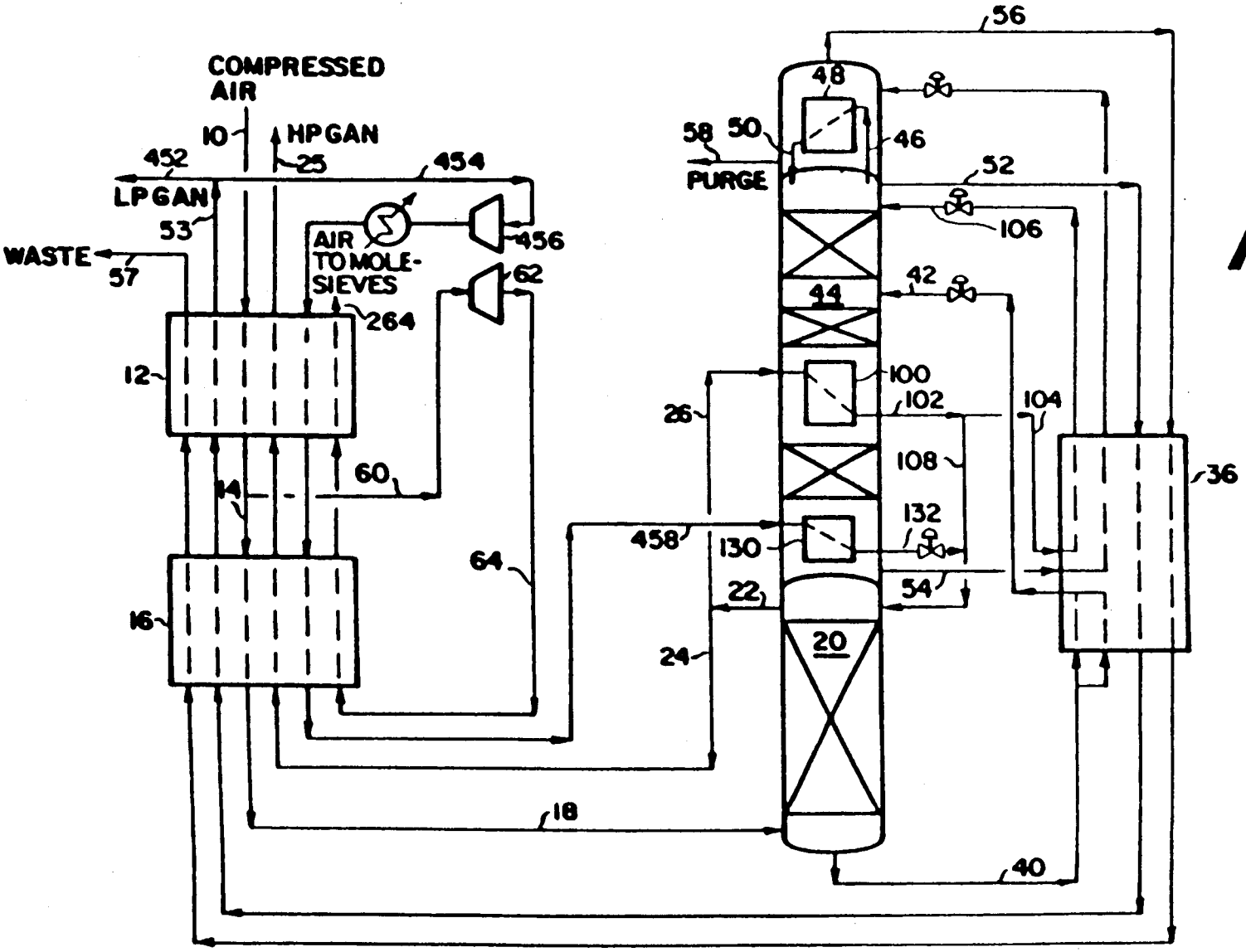

In FIG. 2, the second further portion, in line 126, which is compressed in compressor 128 and condensed in the lower reboiler/condenser 130, was obtained from the HP column nitrogen overhead. It is not always necessary to do that. Any suitable nitrogen stream can be boosted in pressure and recycled to provide the boilup at the bottom of the LP column. Such an example is shown in FIG. 5. In FIG. 5, a portion, in line 454, of the LP column overhead removed via line 52, after warming to recover refrigeration, is compressed in compressor 456, cooled in heat exchangers 12 an 16 and fed, via line 458, to reboiler/condenser 130 to provide the needed reboil. It should be pointed out that in this case the pressure ratio needed across the compressor 456 is much higher than the corresponding FIG. 2 case when high pressure nitrogen overhead is fed to compressor 126. As a result, if a compander system were to be used with expander 62, the amount of nitrogen compressed will be significantly lower than that required for the most efficient operation of the plant and the full potential of this process of the present invention will not be realized. An obvious way to overcome this shortcoming is to make use of a product nitrogen compressor. In most of these applications, nitrogen is needed at much higher pressures (greater than 500 psia) and a multistage compressor is used to compress the product nitrogen. The low pressure nitrogen, in line 52, is fed to the suction of the first stage and the high pressure nitrogen from the cold box is fed to an intermediate stage. One could withdraw a recycle nitrogen stream from a suitable stage of this multistage product compressor and if needed, further boost its pressure using the compressor driven by expander 62 providing the necessary refrigeration for the process.

Figure 6:
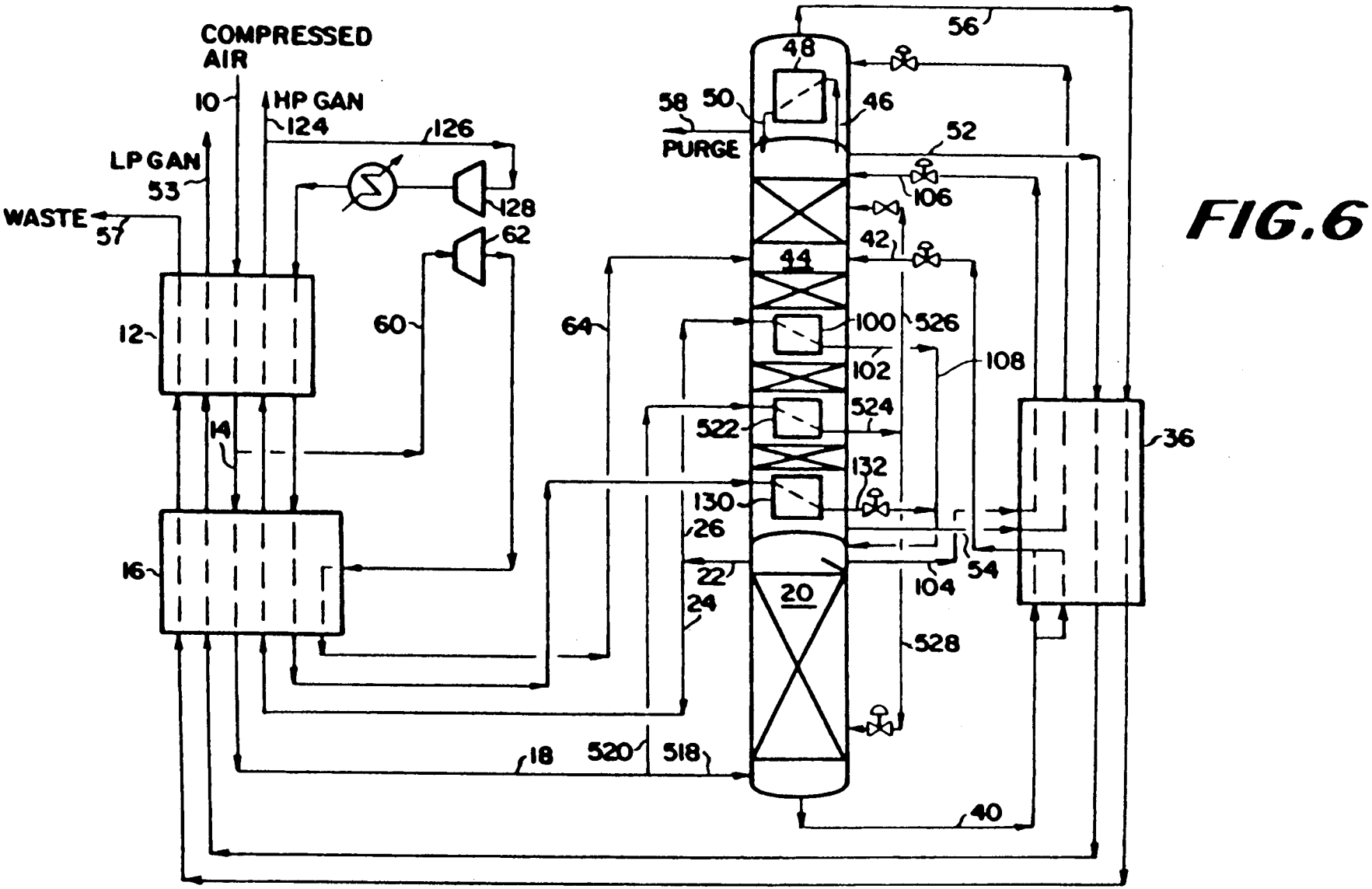

When two nitrogen streams are condensed at different pressures in two reboiler/condensers, a third reboiler/condenser can be prudently added to the stripping section of the LP column with a portion of the feed air being totally condensing in this reboiler/condenser. Although this third reboiler/condenser can be located at any suitable location below the intermediate reboiler/condenser condensing nitrogen directly from the HP column, preferably it should be located in the middle of the other two reboiler/condensers as shown in FIG. 6. At least one distillation tray must be used between each reboiler/condenser. With reference to FIG. 6, a portion of the compressed, cooled feed air, in line 18, is removed via line 520 and fed to and condensed in reboiler/condenser 522, which is located in the stripping section of LP column 44 between reboiler/condensers 130 and 100. The totally condensed feed air portion, in line 524, is split into two portions, each appropriately reduced in pressure, and each appropriately fed to LP column 44 and HP column 20 as impure reflux, via line 526 and 528, respectively. The advantage of this arrangement is that only a small fraction of the feed air needs to be condensed because reboil for LP column 44 is provided primarily by the nitrogen streams. Furthermore, since air is condensed in the middle reboiler/condenser, it can be totally condensed without any pressure boosting as needed by the U.S. Pat. No. 4,448,595. The total condensation of air provides impure reflux to the distillation columns and is more beneficial than the partial condensation of the U.S. Pat. No. 4,582,518. Total condensation of a small fraction of feed air stream (less than 15% of feed air stream to the plant) and its use as impure reflux is not detrimental to the distillation system because sufficient pure nitrogen reflux is provided by the recycle nitrogen stream. Additionally, the use of a third reboiler/condenser makes the separation in the stripper section of LP column 44 more efficient as compared to FIGS. 2-5, since it moves reboiler/condenser 100 slightly higher in the distillation column which allows for a decrease in the HP column operating pressure and thus an overall savings in power. It is evident that the use of a third reboiler/condenser with total condensation of a small fraction of the feed air stream provides a synergistic effect with the other two reboiler/condensers condensing nitrogen at different pressures and is attractive for these applications. Additionally, it does not require any additional rotating equipment. The only added cost is the one associated with that of the additional reboiler/condenser.

The process of the present invention as described in the above embodiments produces nitrogen product at two different pressures. As long as nitrogen product is needed at a pressure higher than the HP column pressure, the low pressure nitrogen stream can be compressed and mixed with the high pressure nitrogen fraction. However, in certain applications, the pressure of final nitrogen product can be lower than that of the HP column pressure but either equal to or higher than the LP column pressure. The above described embodiments can be modified for such an application by reducing the pressure of the high pressure nitrogen from the HP column across a JT valve or producing all the nitrogen at low pressure from the LP column. In either case, the process would become less efficient. In order to overcome this inefficiency, the embodiment shown in FIG. 7 was developed.

Figure 7:
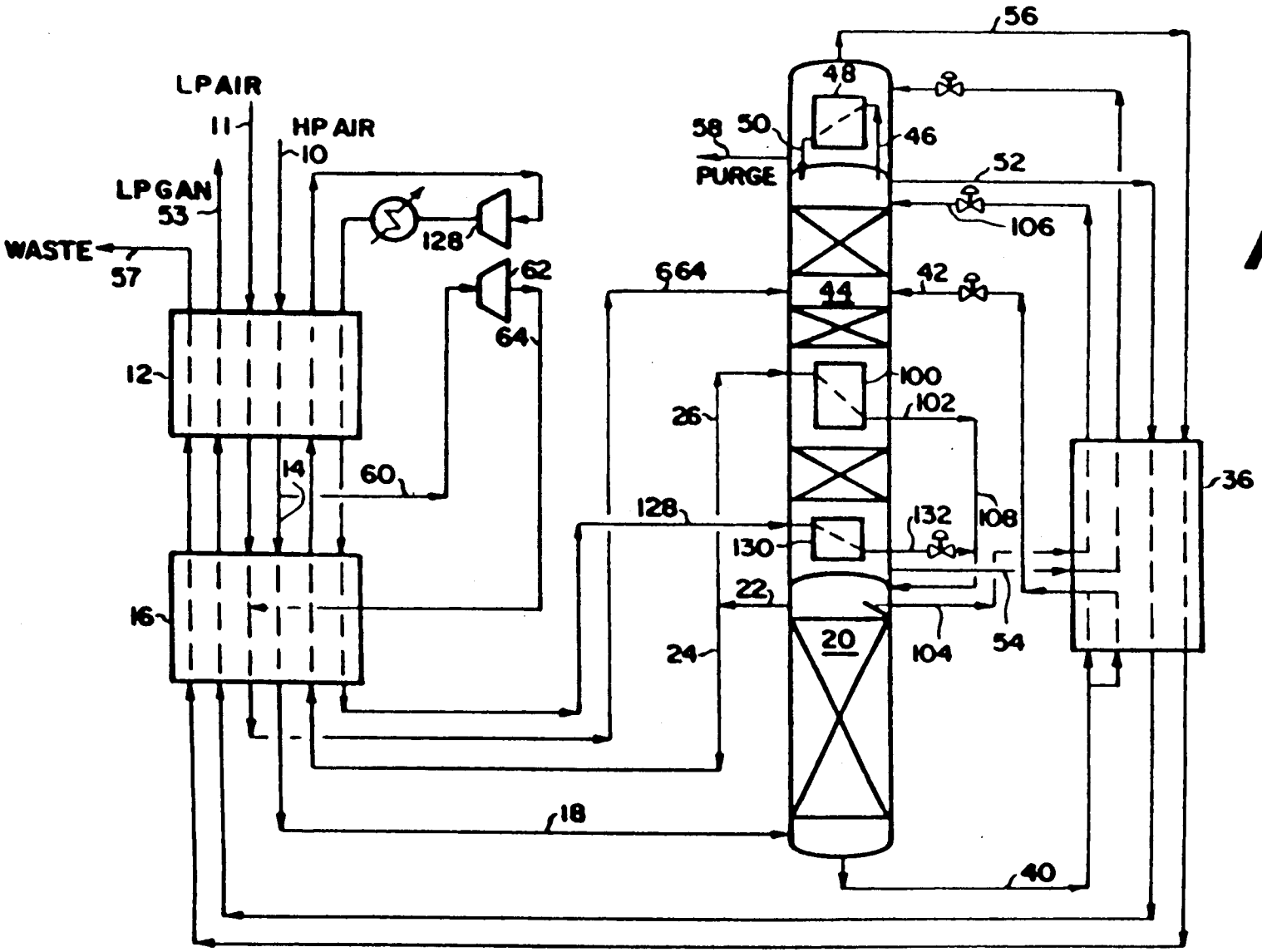

With reference to FIG. 7, compressed feed air is supplied to the cold box at two different pressures via lines 10 and 11. The first feed air stream, in line 10, is at a pressure close to the pressure of HP column 20, is cooled in heat exchangers 12 and 16, and then fed via line 18 to HP column 20. As in FIG. 2, a portion of the first feed air is withdrawn, via line 60 as a side stream, expanded in turboexpander 62 to produce work, and combined via line 64 with the second feed air stream, in line 11. The second or other feed air stream is at a pressure close to the pressure of LP column 44, is cooled in heat exchangers 12 and 16 and then fed via line 664 to an intermediate location of LP column 44. In this FIG. 7, no high pressure nitrogen product is produced from HP column 20. The amount of high pressure air fed via line IB to the HP column 20 is just enough to provide the needed liquid nitrogen reflux streams and reboil in the bottom section of LP column 44. This decreases the flowrate of the air stream to the HP column and contributes to energy savings when product nitrogen stream is needed at a pressure lower than the HP column pressure. The remainder of the configuration of FIG. 7 is similar to FIG. 2.

Figure 8:
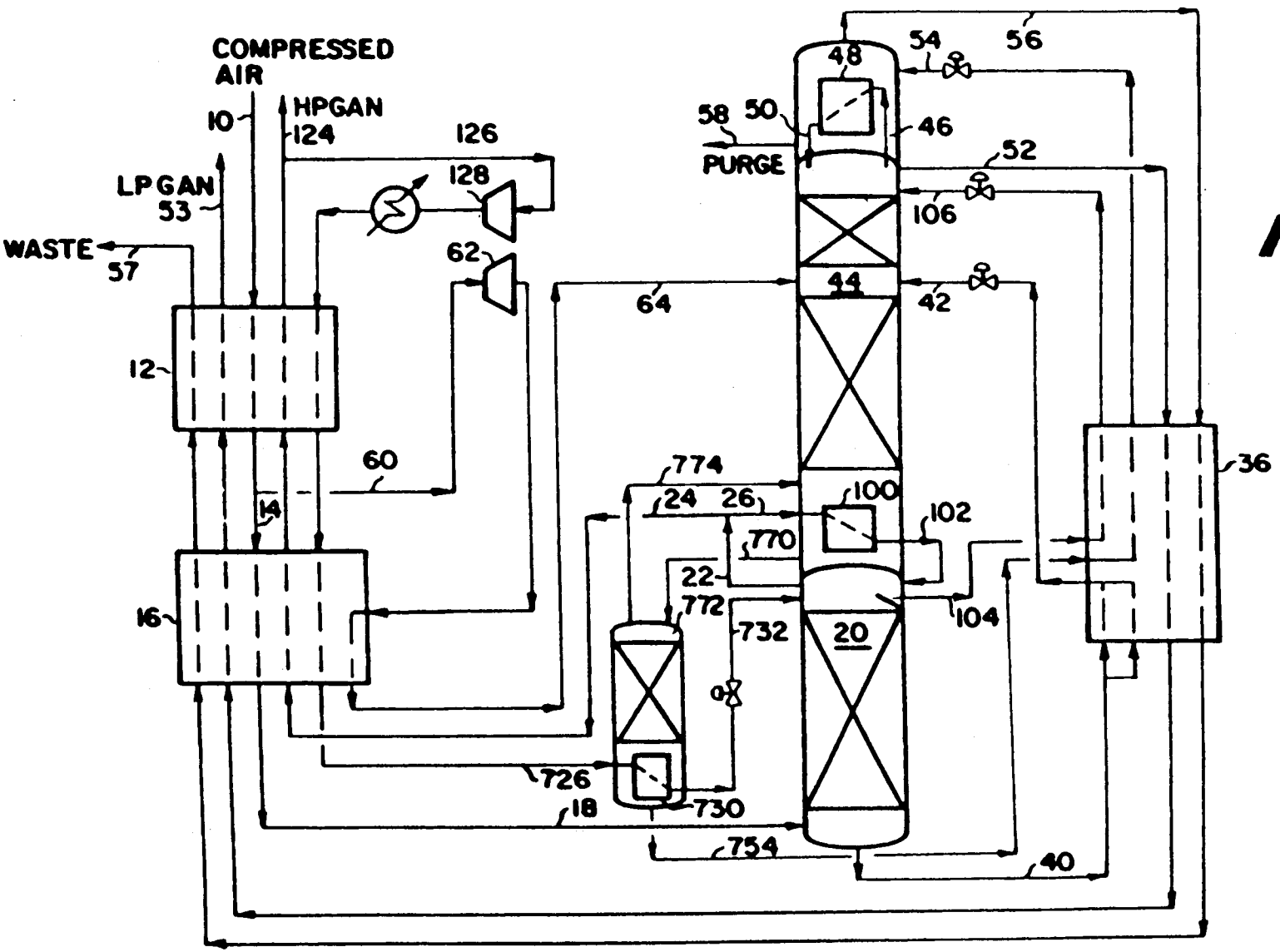

FIGS. 2-7 use more than one reboiler/condenser in the bottom section of LP column 44 which adds height to LP column 44. In certain cases, increased height may be undesirable. For such applications all other intermediate reboiler/condensers except the top most intermediate reboiler/condenser, where nitrogen from the top of the HP column is condensed, can be taken out of the LP column and located in an auxiliary column. This auxiliary column can be located at any suitable height below the sump of the LP column. As an example, a version of FIG. 2 incorporating this feature is shown in FIG. 8. With reference to FIG. 8, the bottom-most reboiler/condenser of FIG. 2 is moved to the bottom of auxiliary column 772 and intermediate reboiler/condenser 100 is now located at the bottom of LP column 44. In this configuration, nitrogen overhead from the top of HP column 20 is fed via lines 22 and 26 to and condensed in reboiler/condenser 100 located in the bottom of LP column 44 thereby partially vaporizing a portion of the bottoms liquid of LP column 44; the condensed nitrogen is returned via line 102 to the top of HP column 40 as reflux. A portion of the non-vaporized bottoms liquid of LP column 44 is withdrawn and fed to auXiliary column 772 via line 770 by gravity wherein it is stripped forming an auxiliary column overhead and an auxiliary column bottoms liquid. Reboil to auxiliary column 772 is provided by condensing recycled compressed nitrogen, in line 726, in reboiler/condenser 730 located in the bottom of auxiliary column 772. The condensed nitrogen is reduced in pressure and fed via line 732 to HP column 20 as reflux; alternatively it could be fed to the top of LP column 44 as reflux. The auxiliary column overhead is withdrawn and fed via line 774 to the bottom of LP column 44. The diameter of auxiliary column 772 is considerably less than the diameter of LP column 44 due to reduced vapor and liquid flowrates in the auxiliary column.

In order to demonstrate the efficacy of the present invention, particularly, its energy advantage, computer simulations were run comparing a few embodiments of the present invention and the closest prior art. These computer simulations are offered in the following examples:

EXAMPLE 1

Figure 1:
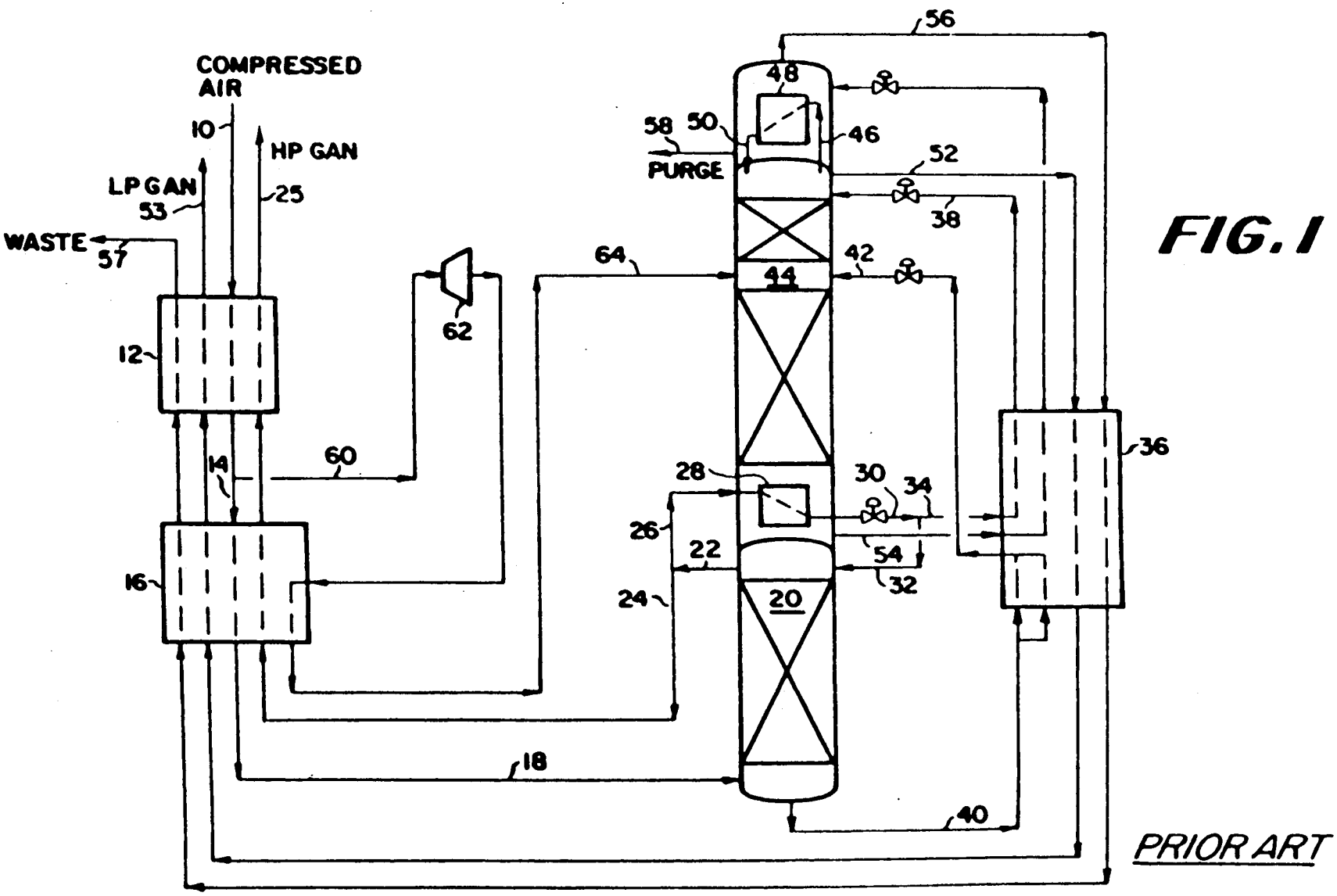
FIG. 1 PRIOR ART
FIG. 1 is a flow diagram of a process derived from the process disclosed in U.K. Pat. No. GB 1,215,377.

Computer simulations were run of the processes depicted in FIGS. 1 and 2 to produce nitrogen products with an oxygen concentration of about 1 vppm. Both high pressure and low pressure nitrogen streams have been produced from the distillation columns and their proportions have been adjusted to minimize the power consumption for each process cycle. In all simulations, the basis is 100 moles of feed air and power has been calculated as Kwh/short ton of product nitrogen. The final delivery pressure of nitrogen is 124 psia and therefore the nitrogen streams from the cold box have been compressed in a product nitrogen compressor to provide a nitrogen product at the desired pressure. For the FIG. 1 case, turboexpander 62 has been simulated to be an electrical generator and credit for the electric power generated has been taken into account in power calculations. For the FIG. 2 case, a compander was used for the power calculation.

The results of the simulations of the process of FIG. 1 and the optimum embodiment of the process of FIG. 2, in particular, pertinent flowrates, pressures and temperatures, are shown in Table I. In addition to a simulation of the optimum embodiment of FIG. 2, other variations were simulated to demonstrate the effect of varying the flowrate of boosted high pressure nitrogen to be condensed in the reboiler/condenser at the bottom of the LP column. These cases were simulated to investigate the effect of varying the relative boilup between the two reboiler/condensers located in the bottom section of the LP column and thus find the minimum power consumption. The power consumptions for the three simulated cases are summarized in Table II.

TABLE I

| Stream Number | Temperature °F. | Pressure psia | Flowrate mol/hr | Composition: mol % Nitrogen | Oxygen | Argon |
|---|---|---|---|---|---|---|
| Figure 1 Embodiment | | | | | | |
| 10 | 55 | 137 | 100.0 | 78.1 | 21.0 | 0.9 |
| 18 | −261 | 132 | 85.6 | 78.1 | 21.0 | 0.9 |
| 22 | −276 | 129 | 95.3 | 100.0 | 0.0 | 0.0 |
| 24 | −276 | 129 | 28.5 | 100.0 | 0.0 | 0.0 |
| 26 | −276 | 129 | 66.8 | 100.0 | 0.0 | 0.0 |
| 38 | −296 | 128 | 7.9 | 100.0 | 0.0 | 0.0 |
| 40 | −268 | 132 | 49.3 | 62.0 | 36.4 | 1.6 |
| 42 | −287 | 63 | 49.3 | 62.0 | 36.4 | 1.6 |
| 46 | −295 | 60 | 35.0 | 100.0 | 0.0 | 0.0 |
| 52 | −295 | 60 | 42.5 | 100.0 | 0.0 | 0.0 |
| 56 | −297 | 18 | 28.8 | 24.7 | 72.1 | 3.2 |
| 60 | −165 | 135 | 14.3 | 78.1 | 21.0 | 0.9 |
| 64 | −274 | 63 | 14.3 | 78.1 | 21.0 | 0.9 |
| Figure 2 Embodiment | | | | | | |
| 10 | 55 | 120 | 100.0 | 78.1 | 21.0 | 0.9 |
| 18 | −267 | 115 | 81.8 | 78.1 | 21.0 | 0.9 |
| 22 | −280 | 113 | 90.3 | 100.0 | 0.0 | 0.0 |
| 24 | −280 | 113 | 46.4 | 100.0 | 0.0 | 0.0 |
| 26 | −280 | 113 | 43.9 | 100.0 | 0.0 | 0.0 |
| 40 | −271 | 115 | 45.9 | 61.1 | 37.3 | 1.6 |
| 42 | −286 | 63 | 45.9 | 61.1 | 37.3 | 1.6 |
| 46 | −295 | 60 | 35.7 | 100.0 | 0.0 | 0.0 |
| 52 | −295 | 60 | 41.0 | 100.0 | 0.0 | 0.0 |
| 56 | −297 | 18 | 28.8 | 24.8 | 72.1 | 3.1 |
| 60 | −165 | 118 | 18.2 | 78.1 | 21.0 | 0.9 |
| 64 | −278 | 63 | 18.2 | 78.1 | 21.0 | 0.9 |
| 104 | −280 | 113 | 5.9 | 100.0 | 0.0 | 0.0 |
| 108 | −280 | 113 | 38.0 | 100.0 | 0.0 | 0.0 |
| 124 | 49 | 109 | 46.4 | 100.0 | 0.0 | 0.0 |
| 126 | 49 | 109 | 16.4 | 100.0 | 0.0 | 0.0 |
| 132 | −276 | 130 | 16.4 | 100.0 | 0.0 | 0.0 |

TABLE 11

| | Basis: Nitrogen Product Pressure: 124 psia Nitrogen Product Quality: 1 vppm $O_2$ | | | | |
|---|---|---|---|---|---|
| | Figure 1 Process | Figure 2 Process | | | |
| | | Case I | Case II | Case III | Case IV |
| Stream 126 Flowrate* | — | 0.1 | 0.164 | 0.2 | 0.3 |

TABLE 11-continued

| Basis: Nitrogen Product Pressure: 124 psia Nitrogen Product Quality: 1 vppm $O_2$ | | | | | |
|---|---|---|---|---|---|
| | Figure 1 | Figure 2 Process | | | |
| | Process | Case I | Case II | Case III | Case IV |
| Tubroexpander Generator | Yes | Yes | No | Yes | Yes |
| Power: Kwh/ton $N_2$ | 127.8 | 125.8 | 124.8 | 125.1 | 125.4 |
| Relative Power | 1.0 | 0.984 | 0.976 | 0.979 | 0.982 |

*moles/moles of fresh feed air

In reference to Table II, the flowrate of the boosted high pressure nitrogen stream 126 to provide the reboil to the bottom of the LP column is varied from 0.1 moles/mole of feed air to 0.3 moles/mole of feed air. As this flowrate is increased, the relative boilup in the bottom most reboiler/condenser of the LP column is increased. As can be seen from Table II, a minimum power requirement is achieved for the boosted high pressure nitrogen stream 126 flowrate of about 0.15 to 0.2 moles/mole of feed air. The optimum power is 2.4% lower than the prior art process of FIG. 1. For large tonnage plants this translates into substantial savings in variable cost of the nitrogen production.

Another observation to be made from Table II is that the minimum in power is achieved for the flowrate of boosted high pressure nitrogen stream 126 which can be boosted in a compressor driven entirely by turboexpander 62, i.e., a compander can be used. This eliminates the need for a capital expenditure to buy a separate compressor. Moreover, for large plants, compander systems often require less capital than the corresponding generator loaded turboexpander. This example demonstrates that the process of the present invention can be practiced at an energy efficiency optimum using a compander system and the energy savings are achieved without a significant capital expenditure.

EXAMPLE 2

Simulations were also run for the embodiments of the process of the present invention where a portion of the feed air is expanded to provide the refrigeration and then warmed and used for mole sieves regeneration, i.e. the embodiments illustrated in FIGS. 3 and 5. Basically, these simulations were done to demonstrate the advantage of compressing via a compander a portion of the low pressure nitrogen and using that compressed nitrogen to provide the boilup in the bottom most reboiler/condenser of the LP column, i.e., the embodiment of FIG. 5.

The process flowrates, pressures and temperatures from the simulations of FIGS. 3 and 5 are shown in Table III. The basis of simulation was the same as for Example 1 with the exception that expander 62 is always tied to compressor 128 or 456 as a compander.

TABLE III

| Stream Number | Temperature °F. | Pressure psia | Flowrate mol/hr | Composition: mol % Nitrogen | Oxygen | Argon |
|---|---|---|---|---|---|---|
| Figure 3 Embodiment | | | | | | |
| 10 | 67 | 113 | 100.0 | 78.1 | 21.0 | 0.9 |
| 18 | −270 | 111 | 88.9 | 78.1 | 21.0 | 0.9 |
| 22 | −281 | 107 | 96.3 | 100.0 | 0.0 | 0.0 |
| 24 | −281 | 107 | 60.1 | 100.0 | 0.0 | 0.0 |
| 26 | −281 | 107 | 36.2 | 100.0 | 0.0 | 0.0 |
| 40 | −273 | 110 | 50.0 | 61.2 | 37.2 | 1.6 |

TABLE III-continued

| Stream Number | Temperature °F. | Pressure psia | Flowrate mol/hr | Composition: mol % Nitrogen | Oxygen | Argon |
|---|---|---|---|---|---|---|
| 42 | −287 | 61 | 50.0 | 61.2 | 37.2 | 1.6 |
| 46 | −295 | 59 | 32.7 | 100.0 | 0.0 | 0.0 |
| 52 | −295 | 59 | 23.9 | 100.0 | 0.0 | 0.0 |
| 56 | −298 | 18 | 26.4 | 26.8 | 70.1 | 3.1 |
| 60 | −134 | 111 | 11.1 | 78.1 | 21.0 | 0.9 |
| 64 | −241 | 21 | 11.1 | 78.1 | 21.0 | 0.9 |
| 104 | −281 | 107 | 0.4 | 100.0 | 0.0 | 0.0 |
| 108 | −281 | 107 | 35.8 | 100.0 | 0.0 | 0.0 |
| 124 | 56 | 102 | 38.4 | 100.0 | 0.0 | 0.0 |
| 126 | 56 | 102 | 21.7 | 100.0 | 0.0 | 0.0 |
| 132 | −276 | 129 | 21.7 | 100.0 | 0.0 | 0.0 |
| Figure 5 Embodiment | | | | | | |
| 10 | 67 | 128 | 100.0 | 78.1 | 21.0 | 0.9 |
| 18 | −265 | 124 | 88.9 | 78.1 | 21.0 | 0.9 |
| 22 | −278 | 122 | 97.1 | 100.0 | 0.0 | 0.0 |
| 24 | −278 | 122 | 43.4 | 100.0 | 0.0 | 0.0 |
| 26 | −278 | 122 | 53.7 | 100.0 | 0.0 | 0.0 |
| 40 | −270 | 124 | 51.1 | 62.0 | 36.4 | 1.6 |
| 42 | −286 | 61 | 51.1 | 62.0 | 36.4 | 1.6 |
| 46 | −295 | 59 | 32.8 | 100.0 | 0.0 | 0.0 |
| 52 | −295 | 59 | 25.2 | 100.0 | 0.0 | 0.0 |
| 56 | −298 | 18 | 26.4 | 26.7 | 70.2 | 3.1 |
| 60 | −133 | 126 | 11.1 | 78.1 | 21.0 | 0.9 |
| 64 | −247 | 21 | 11.1 | 78.1 | 21.0 | 0.9 |
| 104 | −278 | 122 | 0.6 | 100.0 | 0.0 | 0.0 |
| 108 | −278 | 122 | 53.2 | 100.0 | 0.0 | 0.0 |
| 132 | −276 | 129 | 6.2 | 100.0 | 0.0 | 0.0 |
| 452 | 55 | 53 | 19.0 | 100.0 | 0.0 | 0.0 |
| 454 | 55 | 53 | 6.2 | 100.0 | 0.0 | 0.0 |
| 458 | −276 | 129 | 6.2 | 100.0 | 0.0 | 0.0 |

The power consumption for each of the processes of FIGS. 5 and 3 are 130.8 and 129.4 Kwh/ton nitrogen, respectively. The flowrates of recycled compressed nitrogen to reboiler/condenser 130 is 0.062 and 0.217 moles per mole of feed air, respectively. As a comparison, the closest prior art, which is essentially FIG. 1 modified to compress all of the low pressure nitrogen product to the same pressure as the high pressure nitrogen product and the venting of feed air side stream, has a power consumption of 132.5 Kwh/ton nitrogen. As can be observed from the above data, the flowrate of recycled boosted nitrogen is only about 6% of the feed air flow for the flowsheet of FIG. 5 and thus saves about 1.3% power over the base case. On the other hand, when high pressure nitrogen is boosted and recycled in FIG. 3, its flowrate is about 22% of the feed air flow and power consumption is 2.3% lower than the base case.

This example clearly shows that the embodiment of FIG. 5, where a fraction of the low pressure nitrogen is boosted and recycled, also saves power over the prior art. However, in order to fully realize the benefit of the present invention, a larger fraction of this low pressure nitrogen must be boosted in a separate booster compressor to provide the optimum flow. Use of only a booster compressor driven by the turboexpander of the plant provides a small boosted nitrogen stream and hence lower benefits.

For large tonnage nitrogen plants, energy is the major fraction of the overall cost of nitrogen product. As can be seen from the above examples, the present invention provides a process which reduces the power consumption by more than 2% over the processes of the prior art without the addition of any significant capital and, thus, provides an attractive process for the production of tonnage nitrogen.

The described invention accomplishes these described benefits by using more than one reboiler/condensers in the bottom section of the LP column, and, thus, reduces the irreversibility associated with distillation of the prior art processes. Furthermore, unlike the previous processes where a fraction of the feed air is condensed in the bottom most reboilers/condenser of the two reboiler/condensers located in the stripping section of the LP column, the present invention instead condenses a nitrogen stream which is at a pressure higher than the HP column pressure in the bottom most reboiler/condenser; thus, allowing the ability to adjust the proper split in the boiling duty of the reboiler/condensers while maintaining the needed nitrogen reflux for the efficient operation. In the preferred mode, a portion of the high pressure nitrogen stream from the high pressure column is boosted in pressure and is used to provide the boilup duty in the bottom most reboiler/condenser of the LP column. In an optimized process, the booster compressor to boost this high pressure nitrogen stream is driven by the expander providing the refrigeration to the plant. This reduces the extra capital needed by the process of the present invention as compared to the prior art processes to an extremely small value but retains majority of the energy benefit.

The present invention has been described with reference to several specific embodiments thereof. These embodiments should not be viewed as a limitation on the scope of such invention, the scope of which is ascertained from the following claims.

We claim:

1. A cryogenic process for the production of nitrogen by distilling air in a double column distillation system comprising a high pressure column and a low pressure column comprising:

(a) cooling a compressed feed air stream to near its dew point and rectifying the cooled, compressed feed air stream in the high pressure distillation column thereby producing a high pressure nitrogen overhead and a crude oxygen bottoms liquid;

(b) removing the crude oxygen bottoms liquid from the high pressure distillation column, subcooling the removed, crude oxygen bottoms liquid and feeding the subcooled, crude oxygen bottoms liquid to an intermediate location of the low pressure column for distillation;

(c) removing the high pressure nitrogen overhead from the high pressure column and dividing the removed, high pressure nitrogen overhead into a first and second portion;

(d) condensing the first portion of the high pressure nitrogen overhead in an intermediate reboiler/condenser located in the upper portion of the stripping section of the low pressure column thereby providing at least a portion of the heat duty to reboil the low pressure column;

(e) warming and dividing the second portion of the high pressure nitrogen overhead into a high pressure nitrogen product and a recycle nitrogen stream;

(f) compressing the recycle nitrogen stream and condensing it in a reboiler/condenser located in the bottom of the low pressure column thereby providing another portion of the heat duty to reboil the low pressure column;

(g) refluxing the high pressure column with at least a portion of the condensed nitrogen generated in steps (d) or (f); and (h) removing a low pressure nitrogen stream from the top of the low pressure column, warming the removed, low pressure nitrogen stream to recover refrigeration and recovering the warmed, low pressure nitrogen stream from the process as a low pressure nitrogen product.

2. The process of claim 1 which further comprises removing a portion of the cooled, first compressed feed air, and work expanding the removed portion.

3. The process of claim 2 which further comprises further cooling the expanded portion and feeding the further cooled expanded portion to an intermediate location of the low pressure column for distillation.

4. The process of claim 2 which further comprises warming the expanded portion to recover refrigeration and venting the warmed, expanded portion.

5. The process of claim 1 which further comprises removing an oxygen-enriched bottoms liquid from the bottom of the low pressure column; vaporizing the removed, oxygen-enriched bottoms liquid in a reboiler/condenser located in the top of the low pressure column against condensing low pressure nitrogen overhead thereby creating a oxygen-waste stream; and warming the oxygen-waste stream to recover refrigeration.

6. The process of claim 5 which further comprises work expanding the warmed, oxygen-waste stream; and further warming the expanded oxygen-waste stream to recover any remaining refrigeration.

7. The process of claim 1 which further comprises providing additional heat duty for reboil of the low pressure column by condensing a portion of the cooled compressed feed air stream of step (a) in a reboiler/condenser located in the low pressure column between the reboiler/condenser of step (d) and the bottom reboiler/condenser of step (f).

8. A cryogenic process for the production of nitrogen by distilling air in a double column distillation system comprising a high pressure column and a low pressure column comprising:

(a) cooling a compressed feed air stream to near its dew point and rectifying the cooled, compressed feed air stream in the high pressure distillation column thereby producing a high pressure nitrogen overhead and a crude oxygen bottoms liquid;

(b) removing the crude oxygen bottoms liquid from the high pressure distillation column, subcooling the removed, crude oxygen bottoms liquid and feeding the subcooled, crude oxygen bottoms liquid to an intermediate location of the low pressure column for distillation;

(c) removing the high pressure nitrogen overhead from the high pressure column and dividing the removed, high pressure nitrogen overhead into a first and second portion;

(d) condensing the first portion of the high pressure nitrogen overhead in an intermediate reboiler/condenser located in the upper portion of the stripping section of the low pressure column thereby providing at least a portion of the heat duty to reboil the low pressure column;

(e) warming and recovering the second portion of the high pressure nitrogen overhead as a high pressure nitrogen product;

(f) removing a low pressure nitrogen stream from the top of the low pressure column, warming the removed, low pressure nitrogen stream to recover refrigeration and dividing the warmed, low pressure nitrogen stream into a low pressure nitrogen product and a nitrogen recycle stream;

(g) compressing the recycle nitrogen stream and condensing it in a reboiler/condenser located in the bottom of the low pressure column thereby providing another portion of the heat duty to reboil the low pressure column; and (h) refluxing the high pressure column with at least a portion of the condensed nitrogen generated in steps (d) or (g).

9. The process of claim 8 which further comprises removing an oxygen-enriched bottoms liquid from the bottom of the low pressure column; vaporizing the removed, oxygen-enriched bottoms liquid in a reboiler/condenser located in the top of the low pressure column against condensing low pressure nitrogen overhead thereby creating a oxygen-waste stream; and warming the oxygen-waste stream to recover refrigeration.

10. The process of claim 9 which further comprises work expanding the warmed, oxygen-waste stream; and further warming the expanded oxygen-waste stream to recover any remaining refrigeration.

11. The process of claim 7 which further comprises removing a portion of the cooled, first compressed feed air, and work expanding the removed portion.

12. The process of claim 11 which further comprises removing an oxygen-enriched bottoms liquid from the bottom of the low pressure column; vaporizing the removed, oxygen-enriched bottoms liquid in a reboiler/condenser located in the top of the low pressure column against condensing low pressure nitrogen overhead thereby creating a oxygen-waste stream; and warming the oxygen-waste stream to recover refrigeration.

13. The process of claim 12 which further comprises work expanding the warmed, oxygen-waste stream; and further warming the expanded oxygen-waste stream to recover any remaining refrigeration.

* * * * *